United States Patent [19]

DelGreco et al.

[11] 4,438,024

[45] Mar. 20, 1984

[54] STABLE LIQUID DETERGENT COMPOSITIONS

[75] Inventors: Angela G. DelGreco, Hamilton; Malcolm L. Allen, Cincinnati; Ronald L. Jacobsen, Wyoming, all of Ohio

[73] Assignee: The Procter & Gamble Company, Cincinnati, Ohio

[21] Appl. No.: 376,876

[22] Filed: May 10, 1982

[51] Int. Cl.[3] ..... C11D 1/14; C11D 1/75; C11D 17/08

[52] U.S. Cl. ..... 252/545; 252/544; 252/546; 252/547; 252/DIG. 14; 252/153

[58] Field of Search ..... 252/547, 528, 551, 532, 252/545, 546, 529, 548, 553, DIG. 14, 153

[56] References Cited

U.S. PATENT DOCUMENTS

| | | | |
|---|---|---|---|
| 3,281,368 | 10/1966 | Zimmerer et al. | 252/137 |
| 3,341,459 | 9/1967 | Davis | 252/137 |
| 3,351,557 | 11/1967 | Almstead | 252/106 |
| 3,914,185 | 10/1975 | Inamorato | 252/546 |
| 3,928,249 | 12/1975 | Nunziata et al. | 252/526 |
| 3,953,380 | 4/1976 | Sundby | 252/543 |
| 3,963,649 | 6/1976 | Spadini et al. | 252/546 |
| 4,056,113 | 11/1977 | Johnson et al. | 252/526 |
| 4,133,779 | 1/1979 | Hellyer et al. | 252/547 |
| 4,144,201 | 3/1979 | Winterbotham et al. | 252/545 |
| 4,247,424 | 1/1981 | Kuzel et al. | 252/528 |
| 4,259,216 | 3/1981 | Miyajima | 252/545 |
| 4,284,532 | 8/1981 | Leikhim et al. | 252/528 |

FOREIGN PATENT DOCUMENTS

| | | |
|---|---|---|
| 948396 | 2/1964 | United Kingdom . |
| 951930 | 3/1964 | United Kingdom . |
| 1458783 | 12/1976 | United Kingdom . |
| 1458798 | 12/1976 | United Kingdom . |

OTHER PUBLICATIONS

Pending U.S. Patent Application Ser. No. 359,557, Jacobsen et al., filed Mar. 18, 1982.

Pending U.S. Patent Application Ser. No. 254,685, Gajewski et al., filed Apr. 16, 1981.

*Primary Examiner*—John E. Kittle
*Assistant Examiner*—Hoa Van Le
*Attorney, Agent, or Firm*—Donald E. Hasse; Robert B. Aylor; Thomas H. O'Flaherty

[57] ABSTRACT

Stable liquid detergent compositions containing amine oxide and alcohol polyethoxylate sulfate surfactants, a water-soluble detergency builder, an alkanolamine and a hydrotrope are disclosed. The compositions recover, after freezing, to single phase isotropic liquids at relatively low temperatures.

5 Claims, No Drawings

STABLE LIQUID DETERGENT COMPOSITIONS

TECHNICAL FIELD

The present invention relates to liquid detergent compositions containing amine oxide and alcohol polyethoxylate sulfate surfactants, a water-soluble detergency builder, an alkanolamine, a hydrotrope and water. The compositions are single phase isotropic liquids which exhibit improved stability in that, after freezing, they return to a single isotropic phase when thawed at relatively low temperatures.

There has been considerable demand for liquid detergent compositions capable of providing superior detergency under a wide variety of laundering conditions. Such compositions generally require a number of detergent ingredients which tend to separate into discrete phases. Single phase isotropic liquids are desired for both consistency of detergency performance and aesthetic reasons. Because liquid detergents may freeze during shipping and storage under severe weather conditions, there is a need to provide compositions which recover, after freezing, to a single isotropic phase prior to consumer use. Thus liquid detergents preferably should have a recovery temperature of about 50° F. (10° C.) or lower.

BACKGROUND ART

U.S. Pat. No. 4,284,532, Leikhim et al, issued Aug. 18, 1981, discloses stable liquid detergent compositions in isotropic form which contain amine oxide and ethoxylated nonionic surfactants, water-soluble detergency builders and hydrotropes.

Pending U.S. patent application Ser. No. 359,557, Jacobsen et al, filed Mar. 18, 1982, discloses stable liquid detergents containing amine oxide, ethoxylated nonionic and alcohol polyethoxylate sulfate surfactants and water-soluble detergency builders.

U.S. Pat. No. 3,914,185, Inamorato, issued Oct. 21, 1975, discloses that clear liquid detergents containing mixed surfactants and nitrilotriacetate builders can be prepared without gel formation by dissolving the surfactants in a solvent before mixing them with the remaining ingredients.

SUMMARY OF THE INVENTION

The present invention encompasses stable liquid detergent compositions comprising:

(a) an amine oxide surfactant of the formula

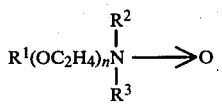

wherein $R^1$ is an alkyl, hydroxyalkyl, alkoxyhydroxypropyl, alkoxyhydroxyethyl, alkyl amido or alkyl carboxylate radical in which the alkyl and alkoxy portions contain from about 8 to about 16 carbon atoms, $R^2$ and $R^3$ are selected from the group consisting of methyl, ethyl, propyl, isopropyl, 2-hydroxyethyl, 2-hydroxypropyl, 3-hydroxypropyl, and said groups joined together to form a cyclic structure in which the nitrogen is part of a heterocyclic ring, and n is from 0 to about 10;

(b) an alcohol polyethoxylate sulfate surfactant of the formula $R^4O(C_2H_4O)_mSO_3M$ wherein $R^4$ is an alkyl or hydroxyalkyl radical containing from about 10 to about 18 carbon atoms, m is from about 0.5 to about 10 and M is a compatible cation;

(c) from about 10% to about 25% by weight of a water-soluble polycarboxylate, polyphosphonate, or polyphosphate detergency builder capable of sequestering calcium and magnesium ions in water solution;

(d) from about 0.5% to about 7% by weight of monoethanolamine, diethanolamine, triethanolamine, or mixtures thereof;

(e) from about 2.5% to about 25% by weight of a hydrotrope; and (f) from about 55% to about 80% by weight of water; said composition containing from about 8% to about 17% by weight of amine oxide and alcohol polyethoxylate sulfate surfactants, provided the molar ratio of amine oxide to alcohol polyethoxylate sulfate is from about 0.6 to about 1.6 and is less than 0.8 only if the water-soluble detergency builder represents less than about 17% or greater than about 19% by weight or the alkanolamine represents less than about 1.8% or greater than about 2.8% by weight, and containing from about 20% to about 40% by weight of the amine oxide and alcohol polyethoxylate sulfate surfactants and the water-soluble detergency builder materials.

DETAILED DESCRIPTION OF THE INVENTION

The liquid detergent compositions herein comprise an amine oxide surfactant, an alcohol polyethoxylate sulfate surfactant, a water-soluble detergency builder, an alkanolamine, a hydrotrope, and water.

The compositions of the invention are single phase, isotropic liquids which exhibit improved stability in that they return, or substantially return, to a single isotropic phase after freezing and thawing at relatively low temperatures. Preferred compositions herein exhibit a recovery temperature of less than about 55° F. (12.7° C.), more preferably less than 50° F. (10° C.). Below the recovery temperature, the compositions herein disproportionate into two distinct phases, an opaque top layer rich in alcohol polyethoxylate sulfate crystals and an isotropic bottom layer. It has been found that the recovery temperature can be lowered by carefully balancing the amine oxide and polyethoxylate sulfate surfactant levels and ratio, the detergency builder level, and to a lesser extent the alkanolamine level. Thus, compositions herein contain from about 8% to about 17%, preferably about 10% to about 13%, by weight of the amine oxide and alcohol polyethoxylate sulfate surfactants and the molar ratio of amine oxide to alcohol polyethoxylate sulfate is from about 0.6 to about 1.6, more preferably about 0.8 to about 1.2. This ratio can be less than 0.8 only if the detergency builder represents less than about 17% or greater than about 19% by weight of the composition or the alkanolamine represents less than about 1.8% or greater than about 2.8% by weight of the composition. In addition, the amine oxide and polyethoxylate sulfate surfactants and the detergency builder materials should represent from about 20% to about 40%, more preferably from about 25% to about 37%, by weight of the composition.

While not intending to be limited by theory, it is believed that the present compositions move across a phase boundary from an isotropic plus crystals region to an isotropic region at the recovery temperature. The amine oxide surfactant, builder and alkanolamine herein are thought to alter electrolytic strength and/or disrupt surfactant crystal formation, thereby providing greater intrinsic solubility and lower recovery (boundary) temperatures.

Amine Oxide Surfactant

The compositions of the present invention contain an amine oxide surfactant of the formula

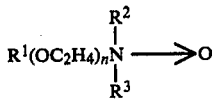

wherein $R^1$ is an alkyl, hydroxyalkyl, alkoxyhydroxypropyl, alkoxyhydroxyethyl, alkyl amino or alkyl carboxylate radical in which the alkyl and alkoxy, respectively, contain from about 8 to about 16 carbon atoms, $R^2$ and $R^3$ are selected from the group consisting of methyl, ethyl, propyl, isopropyl, 2-hydroxyethyl, 2-hydroxypropyl, 3-hydroxypropyl, and said groups joined together to form a heterocyclic structure in which the nitrogen is part of the heterocyclic ring, and n is from 0 to about 10.

Specific examples of amine oxide surfactants include: dimethyldodecylamine oxide, dimethyltetradecylamine oxide, ethylmethyltetradecylamine oxide, cetyldimethylamine oxide, cetylethylpropylamine oxide, diethyldodecylamine oxide, diethyltetradecylamine oxide, dipropyldodecylamine oxide, bis-(2-hydroxyethyl)-dodecylamine oxide, bis(2-hydroxyethyl)-3-dodecoxy-2-hydroxypropylamine oxide, (2-hydroxypropyl)methyltetradecylamine oxide, dimethyl-(2-hydroxydodecyl)amine oxide, $C_{8-16}$ alkyl alphadimethylamine oxide carboxylates, and the corresponding decyl and hexadecyl homologs of the above compounds. A particularly preferred material is $C_{12-16}$ alkyl dimethylamine oxide.

Alcohol Polyethoxylate Sulfate Surfactant

The present compositions also contain an alcohol polyethoxylate sulfate surfactant of the formula $R^4O(C_2H_4O)_mSO_3M$, wherein $R^4$ is an alkyl (preferred) or hydroxyalkyl radical containing from about 10 to about 18 carbon atoms, m is from about 0.5 to about 10 and M is a compatible cation.

The alcohol polyethoxylate sulfate surfactant is essential to the overall performance and stability of the present compositions. It is particularly effective at preventing the gradual yellowing of fabrics which are regularly softened with conventional cationic fabric softening ingredients such as ditallowdimethylammonium chloride.

Preferred alcohol polyethoxylate sulfate surfactants of the above formula are those wherein the $R^4$ substituent is an alkyl radical containing from about 12 to about 18 carbon atoms and m is from about 1 to about 4. Examples of such materials are $C_{12-15}$ alkyl polyethoxylate (2.2) sulfate ($C_{12-15}$ $E_{2.2}S$); $C_{14-15}E_{2.2}S$; $C_{12-13}E_1S$; $C_{16-18}E_4S$; $C_{14-15}E_3S$; and mixtures thereof. The sodium, potassium, monoethanolammonium, and triethanolammonium salts of the above, and mixtures thereof, are preferred.

Water-Soluble Detergency Builder

The compositions herein also contain from about 10% to about 25%, preferably from about 15% to about 22%, by weight of a water-soluble polycarboxylate, polyphosphonate, or polyphosphate detergency builder capable of sequestering calcium or magnesium ions in water solution.

The essential detergency builders of the present invention have the ability to sequester calcium or magnesium ions in water solution, and also maintain or assist in maintaining an alkaline pH in a washing solution. Sequestration is the formation of coordination complexes with metallic ions to prevent or inhibit precipitation or other interfering reactions. The phenomenon is also called chelation if certain structural criteria are met by the coordination complex.

Suitable polycarboxylate builders herein include the various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates.

Examples of such polycarboxylate builders are sodium and potassium ethylenediaminetetraacetate: sodium and potassium nitrilotriacetate: the water-soluble salts of phytic acid, e.g., sodium and potassium phytates, disclosed in U.S. Pat. No. 2,739,942, Eckey, issued Mar. 27, 1956, incorporated herein by reference; the polycarboxylate materials described in U.S. Pat. No. 3,364,103, incorporated herein by reference; and the water-soluble salts of polycarboxylate polymers and copolymers described in U.S. Pat. No. 3,308,067, Diehl, issued Mar. 7, 1967, incorporated herein by reference.

Useful detergent builders include the water-soluble salts of polymeric aliphatic polycarboxylic acids having the following structural and physical characteristics: (a) a minimum molecular weight of about 350 calculated as to the acid form; (b) an equivalent weight of about 50 to about 80 calculated as to acid form; (3) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

Other polycarboxylates for use herein are the polyacetal carboxylates described in U.S. Pat. No. 4,144,226, issued Mar. 13, 1979 to Crutchfield et al, and U.S. Pat. No. 4,146,495, issued Mar. 27, 1979 to Crutchfield et al, incorporated herein by reference.

Preferred polycarboxylate builders for use in the present invention are sodium and potassium nitrilotriacetate, sodium and potassium citrate, and mixtures thereof. Sodium and potassium nitrilotriacetate as particularly preferred.

Polyphosphonate builders useful herein are disclosed in U.S. Pat. No. 3,213,030, Diehl, issued Oct. 19, 1965, U.S. Pat. No. 3,433,021, Roy, issued Jan. 14, 1968, U.S. Pat. No. 3,292,121, Gedge, issued Jan. 9, 1969 and U.S. Pat. No. 2,599,807, Bersworth, issued June 10, 1952, all incorporated herein by reference. Preferred polyphosphonate builders are the sodium and potassium salts of ethylene diphosphonic acid, ethane 1-hydroxy-1,1-diphosphonic acid, and ethane-1,1,2-triphosphonic acid.

Preferred aminopolyphosphonate builders are the sodium and potassium salts of diethylenetriaminepentamethylenephosphonic acid, hexamethylenediaminetetramethylenephosphonic acid, diethylenediaminetetramethylenephosphonic acid, and nitrilotrimethylenephosphonic acid.

Polyphosphates useful herein include the water-soluble tripolyphosphates, pyrophosphates, and the polymeric metaphosphates having a degree of polymerization of from about 6 to 21. However, the tripolyphosphates and metaphosphates tend to hydrolyze to a mixture of orthophosphate and pyrophosphate with prolonged storage in aqueous solutions. Since the orthophosphates precipitate but do not sequester water-hardness ions, the pyrophosphates are the preferred polyphosphates for use in the present invention. Particularly preferred is potassium pyrophosphate since sodium pyrophosphate has a tendency to precipitate from concentrated solutions at low storage temperatures. The pyrophosphates are preferably used at levels less than about 15% by weight for greatest stability.

It is to be understood that while the alkali metal, and particularly the sodium and potassium, salts of the foregoing detergency builders are preferred for use herein from economic and solubility standpoints, the ammonium, alkanolammonium, e.g., triethanolammonium, diethanolammonium, and the like, water-soluble salts of any of the foregoing builders can be used.

Alkanolamine

The present compositions contain from about 0.5% to about 7%, preferably from about 2% to about 4%, by weight of monoethanolamine, diethanolamine, triethanolamine, or mixtures thereof. The alkanolamine provides needed reserve alkalinity for optimum detergency performance. Monoethanolamine (MEA) is highly preferred as the buffering agent.

Hydrotrope

The compositions herein also contain from about 2.5% to about 25%, preferably from about 3% to about 10%, most preferably from about 4% to about 7%, by weight of a hydrotrope. The hydrotrope helps to solubilize the surfactants and builders in the water phase under a wide variety of conditions. The types and levels of hydrotropes needed to produce single-phase isotropic liquid detergents will be dependent on the types and levels of the other components.

The hydrotropes of the present invention are water soluble and preferably have an HLB value above about 14. Suitable hydrotropes have shorter alkyl chain lengths than the corresponding surfactants typically used in detergent compositions. For example, the soluble salts, particularly the sodium and potassium salts, of toluene sulfonate, xylene sulfonate, and cumene sulfonate are preferred hydrophilic stabilizing agents in the practice of the invention; a $C_{11-15}$ alkylbenzene sulfonate typically used in household detergent compositions is not suitable. The cations are the same as or compatible with those of the anionic alcohol polyethoxylate sulfate surfactants herein.

Phosphate esters, particularly those with a predominance of single alkyl groups and designated primary esters, can have the hydrophilic characteristics necessary to assist in the formation of an isotropic liquid detergent composition. Emphos PS-413 and PS-236 (Witco Chemical Company) and Gafac PE-510 (GAF Corporation) are commercially available phosphate materials suitable as the hydrotrope in the practice of the invention. Preferred phosphate esters will contain a high proportion of monoalkyl phosphate esters and can be of the type consisting of the condensation product of the reaction of $R(OC_2H_4)_xOH$ and a phosphoric or polyphosphoric acid, R being an alkyl or alkyl phenyl group, said alkyl containing from about 4 to about 18 carbon atoms and x being 0 to 20.

Ethoxylated nonionic surfactants with a relatively high degree of ethoxylation and a corresponding high HLB value can find use in the compositions of the present invention.

Mixtures of hydrotropes, especially mixtures of lower alkylbenzene sulfonates, such as toluene sulfonate, and phosphate esters, can be used, but preferably no phosphorus is present.

Water

The compositions of this invention contain from about 55% to about 80% by weight of water.

Optional Components

The compositions of the present invention can contain minor amounts of a suds modifying agent, such as fatty acids and the fatty amide surfactants, silicone materials, microcrystalline waxes and phosphate esters described in U.S. Pat. No. 4,284,532, Leikhim et al, issued Aug. 18, 1981, particularly from Column 7, line 25 to Column 9, line 8, incorporated herein by reference. The fatty acid soap and ester mixtures described in U.S. Pat. No. 4,017,409, Demessemaekers et al, issued Apr. 12, 1977, incorporated herein by reference, are also useful suds suppressors herein.

Optional components which can also be added in minor amounts (generally less than about 5%, preferably less than 2% by weight) to the compositions of the present invention include cosurfactants; cobuilders; bleaching agents; bleach activators; soil release agents; soil suspending agents; corrosion inhibitors; dyes; fillers; optical brighteners; germicides; pH adjusting agents; alkalinity sources; enzymes; enzyme-stabilizing agents; perfumes; carriers; opacifiers; and the like. The solution pH provided by the present compositions should be from about 8 to about 13, but preferably is from about 9.5 to about 11. It can be obtained using suitable alkaline materials such as sodium hydroxide, sodium or potassium carbonate or bicarbonate, sodium or potassium silicates, or the alkanolamines herein. Particularly preferred is monoethanolamine.

The compositions herein can contain minor amounts (generally less than 3% by weight) of organic solvents such as aliphatic monohydric alcohols and alkylene glycol monoalkyl ethers. However, the compositions are preferably substantially free of these solvents since they tend to withdraw water from the system and reduce stability.

All percentages, parts, and ratios used herein are by weight unless otherwise specified.

The following nonlimiting Examples I–IV illustrate the compositions of the present invention.

EXAMPLES

| Component | Wt. % | | | | | |
|---|---|---|---|---|---|---|
| | I | II | III | IV | V | VI |
| $C_{12-16}$ alkyl dimethylamine oxide | 4.2 | 4.2 | 4.6 | 3.7 | 3.3 | 3.0 |
| Sodium $C_{14-15}$ alkyl polyethoxy$_{(2.25)}$sulfate | 7.4 | 7.4 | 8.9 | 6.6 | 8.3 | 8.5 |
| Sodium toluene sulfonate | 5.0 | 5.0 | 5.0 | 4.2 | 5.0 | 5.0 |
| Sodium nitrilotriacetate | 18.2 | 25.0 | 18.2 | 15.5 | 18.2 | 18.2 |
| Monoethanolamine | 2.3 | 2.3 | 3.3 | 2.3 | 2.3 | 2.25 |
| Oleic fatty acid | 0.4 | 0.4 | 0.4 | 0.4 | 0.4 | 0.4 |
| Water and minors | Balance to 100 | | | | | |
| Mole ratio amine oxide to polyethoxylate sulfate | 1.02 | 1.02 | 0.92 | 1.01 | 0.71 | 0.63 |

The above compositions were prepared by mixing the components to form single phase isotropic liquids. Samples of each composition were frozen at 0° F. (−17.8° C.) overnight. The samples were then thawed at the indicated temperatures and stored at the same temperatures for a period of two weeks to establish equilibrium. The samples exhibited the following characteristics.

| Temp. (°C.) | I | II | III | IV | V | VI |
|---|---|---|---|---|---|---|
| −1.1 | Opaque Top Layer | Opaque | Opaque | Opaque | Opaque Top Layer | Opaque |
| 4.4 | Opaque Top Layer | Opaque | Opaque | OK | Opaque Top Layer | Opaque Top Layer |
| 10.0 | OK | OK | OK | OK | Opaque Top Layer | Opaque Top Layer & ppt. |
| 21.1 | OK | OK | OK | OK | OK | OK |

*OK means sample was a single phase isotropic liquid.

In a similar test, the composition of Example 1 was found to recover to a single phase isotropic liquid at about 43°–45° F. (6.1°–7.2° C.), whereas the composition of Example V recovered at about 64°–67° F. (17.8°–19.4° C.).

The above results demonstrate that Compositions I–IV of the present invention recover, after freezing, to single phase isotropic liquids at lower temperatures than do Compositions V and VI.

Other compositions of the present invention are obtained if Example V is modified by adjusting the sodium nitrilotriacetate level to about 16% or about 22%, or by adjusting the monoethanolamine level to about 1.5% or 3.4%. Such modified compositions recovered under similar testing to single phase isotropic liquids by 50° F. (10° C.).

Other compositions herein are obtained if the sodium nitrilotriacetate in Examples I through IV is replaced with sodium citrate, sodium ethane 1-hydroxy-1,1-diphosphonate, or with a 1:1 weight ratio of potassium pyrophosphate and sodium citrate.

What is claimed is:

1. A stable liquid detergent composition that recovers, after freezing, to a single isotropic phase by 50° F., comprising:

(a) a $C_{12-16}$ alkyl dimethylamine oxide surfactant;

(b) an alcohol polyethoxylate sulfate surfactant of the formula $R^4O(C_2H_4O)_mSO_3M$ wherein $R^4$ is an alkyl radical containing from about 12 to about 18 carbon atoms, m is from about 1 to about 4, and M is a compatible cation;

(c) from about 15% to about 25% by weight of a water-soluble nitrilotriacetate detergency builder capable of sequestering calcium and magnesium ions in water solution;

(d) from about 2% to about 4% by weight of monoethanolamine;

(e) from about 4% to about 7% by weight of a hydrotrope selected from the group consisting of the water-soluble salts of toluene sulfonate, xylene sulfonate, cumene sulfonate, and mixtures thereof; and (f) from about 55% to about 80% by weight of water; said composition containing from about 8% to about 17% by weight of amine oxide and alcohol polyethoxylate sulfate surfactants, provided the molar ratio of amine oxide to alcohol polyethoxylate sulfate is from about 0.8 to about 1.2, and containing from about 25% to about 37% by weight of the amine oxide and alcohol polyethoxylate sulfate surfactants and the water-soluble nitrilotriacetate builder.

2. The composition of claim 1 wherein in the polyethoxylate sulfate surfactant $R^4$ is an alkyl radical containing from about 14 to about 15 carbon atoms and m is about 2.25.

3. The composition of claim 1 comprising from about 10% to about 13% by weight of the amine oxide and polyethoxylate sulfate surfactants.

4. The composition of claim 1 comprising from about 15% to about 22% by weight of sodium or potassium nitrilotriacetate.

5. A stable liquid detergent composition that recovers, after freezing, to a single isotropic phase by 50° F., comprising by weight about 4.2% of $C_{12-16}$ alkyl dimethylamine oxide, about 7.4% sodium $C_{14-15}$ alkyl polyethoxy (2.25) sulfate, about 5% sodium toluene sulfonate, about 18.2% sodium nitrilotriacetate, about 2.3% monoethanolamine, and the balance being water and minor ingredients.

* * * * *